US006678351B1

(12) United States Patent
Perry et al.

(10) Patent No.: US 6,678,351 B1
(45) Date of Patent: Jan. 13, 2004

(54) LASER RADIOGRAPHY FORMING BREMSSTRAHLUNG RADIATION TO IMAGE AN OBJECT

(75) Inventors: Michael D. Perry, Livermore, CA (US); Joseph A. Sefcik, Tracy, CA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/564,957

(22) Filed: May 4, 2000

Related U.S. Application Data

(60) Provisional application No. 60/133,053, filed on May 6, 1999.

(51) Int. Cl.[7] ..... G21G 4/00

(52) U.S. Cl. ..... 378/119; 378/5; 378/121

(58) Field of Search ..... 372/5; 378/119, 378/5, 121, 4, 87

(56) References Cited

U.S. PATENT DOCUMENTS 4,058,486 A * 11/1977 Mallozzi et al. ..... 250/493
5,335,258 A * 8/1994 Whitlock ..... 378/122
5,680,429 A * 10/1997 Hirose et al. ..... 378/43
5,703,923 A * 12/1997 Bardash ..... 378/87
5,930,331 A * 7/1999 Rentzepis et al. ..... 378/136
6,332,017 B1 * 12/2001 Carroll et al. ..... 378/119

* cited by examiner

*Primary Examiner*—David V. Bruce
*Assistant Examiner*—Therese Barber
(74) *Attorney, Agent, or Firm*—Gary R. Drew; William C. Daubenspeck; Paul A. Gottlieb

(57) ABSTRACT

A method of imaging an object by generating laser pulses with a short-pulse, high-power laser. When the laser pulse strikes a conductive target, bremsstrahlung radiation is generated such that hard ballistic high-energy electrons are formed to penetrate an object. A detector on the opposite side of the object detects these electrons. Since laser pulses are used to form the hard x-rays, multiple pulses can be used to image an object in motion, such as an exploding or compressing object, by using time gated detectors. Furthermore, the laser pulses can be directed down different tubes using mirrors and filters so that each laser pulse will image a different portion of the object.

24 Claims, 4 Drawing Sheets

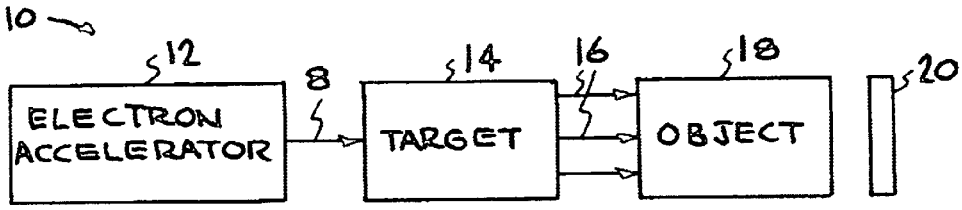
FIG. 1 (PRIORT ART)
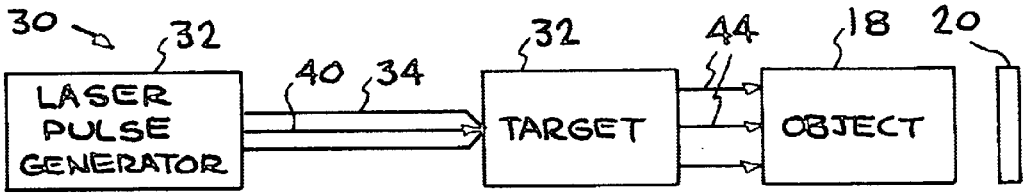
FIG. 2
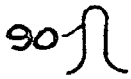
FIG. 4A
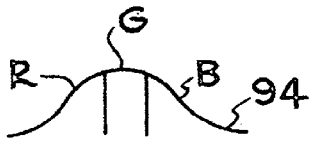
FIG. 4B
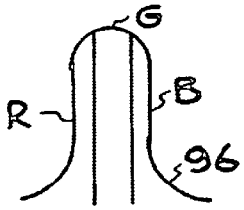
FIG. 4C
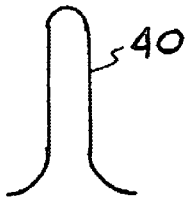
FIG. 4D

LASER RADIOGRAPHY FORMING BREMSSTRAHLUNG RADIATION TO IMAGE AN OBJECT

This application claims priority to provisional patent application Ser. No. 60/133,053, filed May 6, 1999, titled "Laser Radiography".

The United States Government has rights in this invention pursuant to Contract No. W-7405-ENG-48 between the United States Department of Energy and the University of California.

BACKGROUND OF THE INVENTION

1. Field of the Invention

This invention relates to methods for generating x-rays by using laser driven sources for high-energy radiography.

2. Description of the Related Art

Referring to FIG. 1, a conventional x-ray machine 10 is shown. The electron accelerator bremsstrahlung source 12, for example, a flash x-ray (FXR) source, creates high velocity electrons 8 directed toward a target 14. These electrons have an energy level of 15 MeV. The typical target 14 consists of several layers of materials sandwiched together with a thick radiator layer of, for example, tantalum 22 (1 mm thick). As the high velocity electrons pass through the target 14, bremsstrahlung x-rays 16 are formed and pass through the object 18 to form an image on detection plate 20. One disadvantage of the FXR source is that the source needs to be close to the target when generating the high-energy electrons, because these electrons quickly dissipate over short distances. Since these electron accelerator sources are extremely large, there is a limit to the number of multiple axis views that can be performed on an object 18 at one time. If the tests performed on the object are destructive, for example, an impact or explosive experiment, then exposure to only one or two detection plates 20 is possible.

In addition, the "burst" of high-energy electrons usually lasts a long period of time, such as tens of nanoseconds, causing a substantial amount of scattered x-rays that will affect the exposure of the detection plates. Also, it may take a long time for the energy fields created by the electron accelerator source to dissipate before another procedure can be performed. Therefore, there is usually inferior spatial and temporal resolution of the imaged object by using conventional electron accelerators.

SUMMARY OF THE INVENTION

The present invention discloses a method and apparatus for imaging an object by generating laser pulses with a short-pulse, high-power laser. When the laser pulse strike a conductive target, Bremsstrahlung radiation is generated such that hard ballistic high-energy electrons are formed to penetrate an object. A detector located on the opposite side of the object detects these electrons. The detector could be time gated in order to detect specific ballistic high-energy electrons.

An object of the invention is to form hard x-rays from the bremsstrahlung radiation to image objects.

Another object of -the invention is use multiple laser pulses to image an object in motion, for example, an exploding or imploding object.

Another object of the invention is to generate multiple laser pulses that can be directed down different tubes using mirrors and beam splitters so that each laser pulse will image a different portion of the object.

Other objects and advantages of the present invention will become apparent when the apparatus of the present invention is considered in conjunction with the accompanying drawings, specification, and claims.

BRIEF DESCRIPTION OF THE DRAWINGS

For a better understanding of the invention and further features thereof, reference is made to the following detailed description of the invention to be read in connection with the accompanying drawings, wherein:

FIG. 1 depicts a prior art x-ray source;

FIG. 2 shows a radiography system of the present invention described as the first preferred embodiment;

FIG. 4A–4D shows the pulse at several stages passing through the high-energy ultra-short pulse generator of the first preferred embodiment;

DESCRIPTION OF THE PREFERRED EMBODIMENT

While this invention is described in some detail herein, with specific reference to illustrated embodiments, it is to be understood that there is no intent to be limited to these embodiments. On the contrary, the aim is to cover all modifications, alternatives and equivalents falling within the spirit and scope of the invention as defined by the claims.

Figure 5:
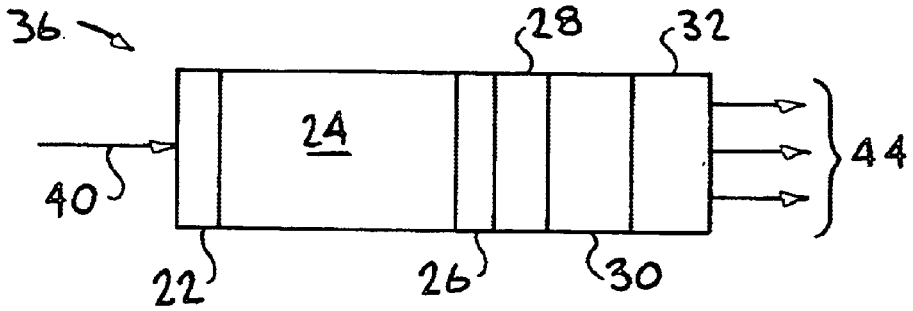
FIG. 5 depicts the target used in the first preferred embodiment of the present invention.
Figure 6:
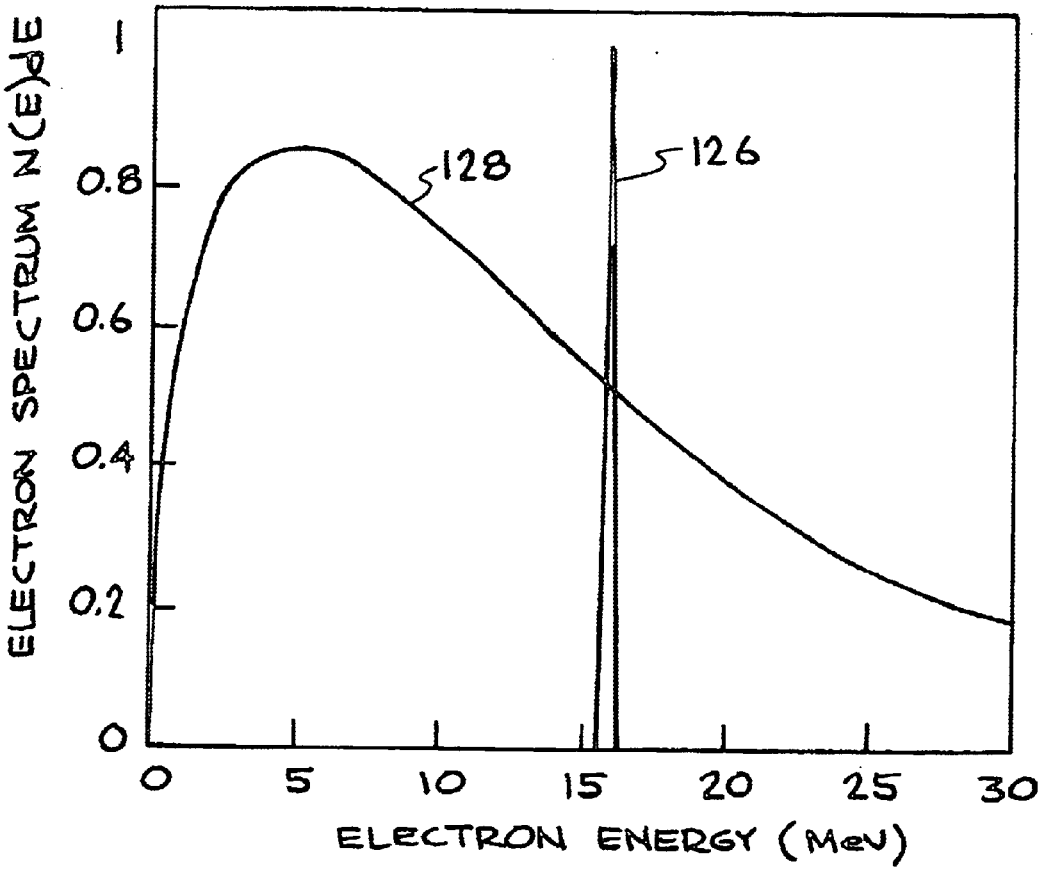
FIG. 6 shows a graph comparing the concentration of electrons at specific energies between the FXR source and the pulsed laser source of the present invention.

A radiographic laser 30 of the first preferred embodiment will be described with reference to FIGS. 2–5. In FIG. 2, a high power laser pulse generator 32 generates a high-energy ultra-short pulse 40. The conduit 34 directs the pulse 40, which can travel a long distance without attenuation, toward the target 36. In the first preferred embodiment, the laser pulse has an energy level of $10^{21}$ W/cm$^2$. As shown in FIG. 5, the target 36 uses a material 22 (approximately 1 mm thick) with high electrical conductivity such as gold or copper. It is preferable to have target density of at least 5 g/cm$^3$. As an example, the remaining layers could be: beryllium 24 (4.4 mm thick), copper 26 (0.7 mm thick), aluminum 28 (3 mm thick), aluminum oxide 30 (1 mm thick) and polyester 32 (3.7 mm thick). However, the one layer of gold without the filler layers would be adequate. The high conductivity in the material is necessary to provide a sufficient return current in the target in order to neutralize the strong space-charge potential created by the rapid depletion of electrons from the target region.

Figure 3:
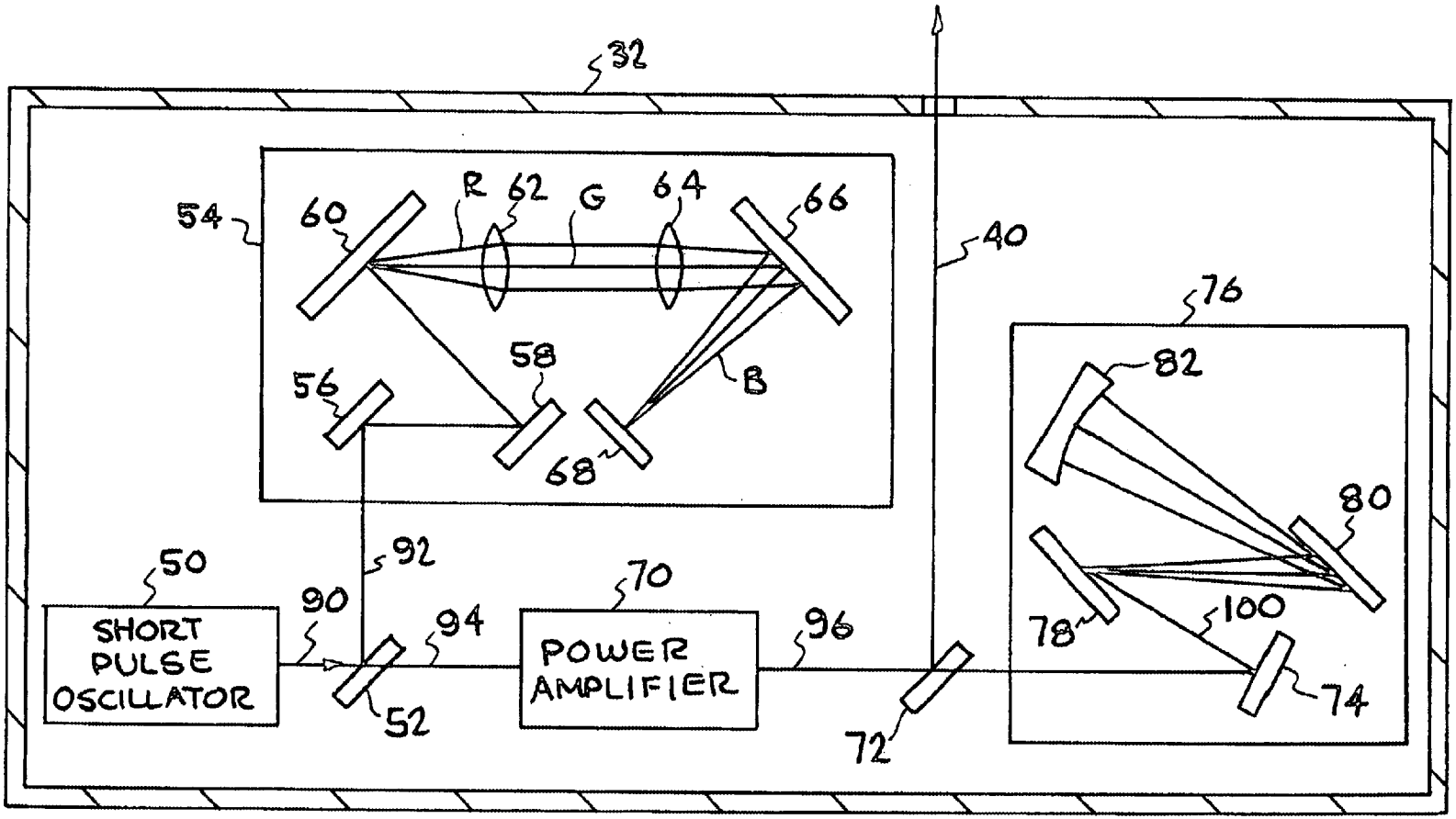
FIG. 3 shows a detail drawing of the high-energy ultra-short pulse generator of the first preferred embodiment.

Referring to FIG. 3, the high power laser pulse (HPLP) generator 32 will be described in detail. A short-pulse oscillator 50 generates an initial short pulse 90 as shown in FIG. 4A. For example, the initial short pulse 90 is 0.1 psec long with a power that is only a few milliwatts. If this short pulse 90 were simply amplified, the power amplifiers 70 would be destroyed. Therefore, using a grating system 54 spreads the short pulse 90 out. In this configuration, the beam splitter 52 directs the pulse 92 to mirrors 56, 58, which direct the short pulse 90 to diffraction grating 60 that separates the different wavelengths. In this lo figure, only three colors (red, green, blue as noted by R, G, B respectively) are shown. However, the full spectrum would actually be spread out and directed through lenses 62, 64 to the second diffraction grating 66 and the mirror 68. As the wavelengths are reflected back through the grating system 54, the light that travels the shortest distance, for example B, would pass through beam splitter 52 first. As shown in FIG. 4B, the pulse 92 is a long low-power pulse with the blue light traveling as the front of the wave. In this example, the pulse would now be 2000 psec long still at the low power of several milliwatts.

The pulse 94 is now amplified by passing through power amplifiers 70. The resulting high-energy pulse 94 is shown in FIG. 4C. It still has the same color spectrum, but now at the much higher power level of several gigawatts. The high-energy pulse is passed through a reverse grating system 76 by being reflected by mirror 74 toward gratings 78, 80 and concave mirror 82. The resulting high-energy, ultra-short pulse 40 is directed toward the target by a mirror 96. FIG. 4D shows the high-energy ultra-short pulse is now 0.3 psec, but with a petawatt ($10^{21}$ W/cm$^2$) power level.

Referring to FIG. 2, the high-energy ultra-short laser pulse 40 is directed toward the target 36, via the conduit 34. The advantage of this system is that the source of the pulse can be at any distance from the target 36. Therefore, the bulky laser pulse generator can be far away from the object to be imaged. As the laser pulse 40 penetrates the target 36, hard x-rays 44 are produced as Bremsstrahlung radiation from the interaction of electrons with the nuclei of the dense target (Au) atoms. The smaller the area of the target that the laser pulse 40 hits, the more focused the x-ray beam 44 will be when exiting the target 36. The conventional electron beam sources focus the electron beam to an area about 2 millimeters in diameter. In contrast, the laser pulse can be focused to an area of only 50 microns in diameter. Therefore, the smaller diameter x-ray spot produced by the laser improves imaging resolution.

Figure 7:
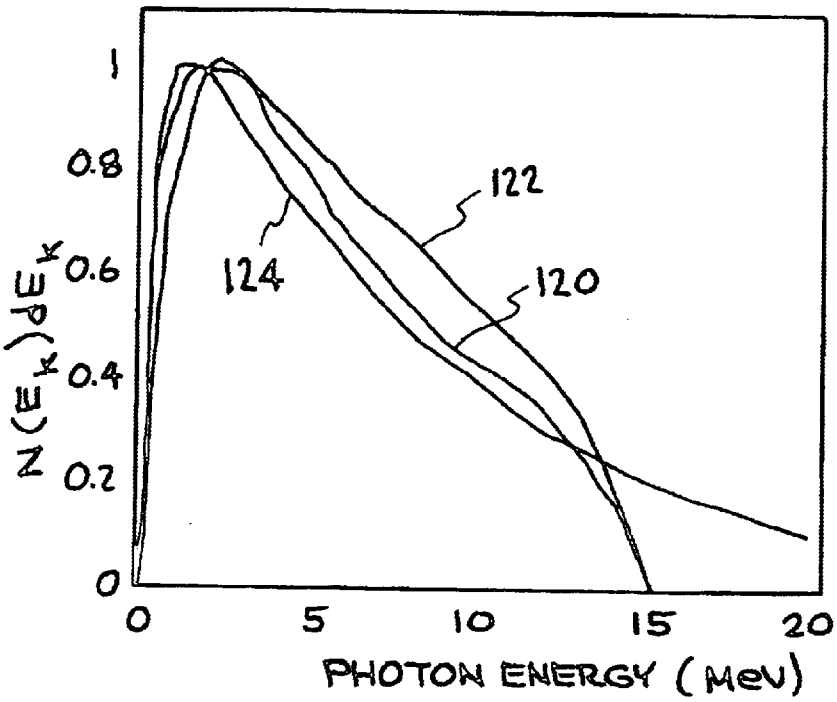
FIG. 7 shows a graph comparing the photon energy of the prior art with the first preferred embodiment of the present invention.
Figure 8:
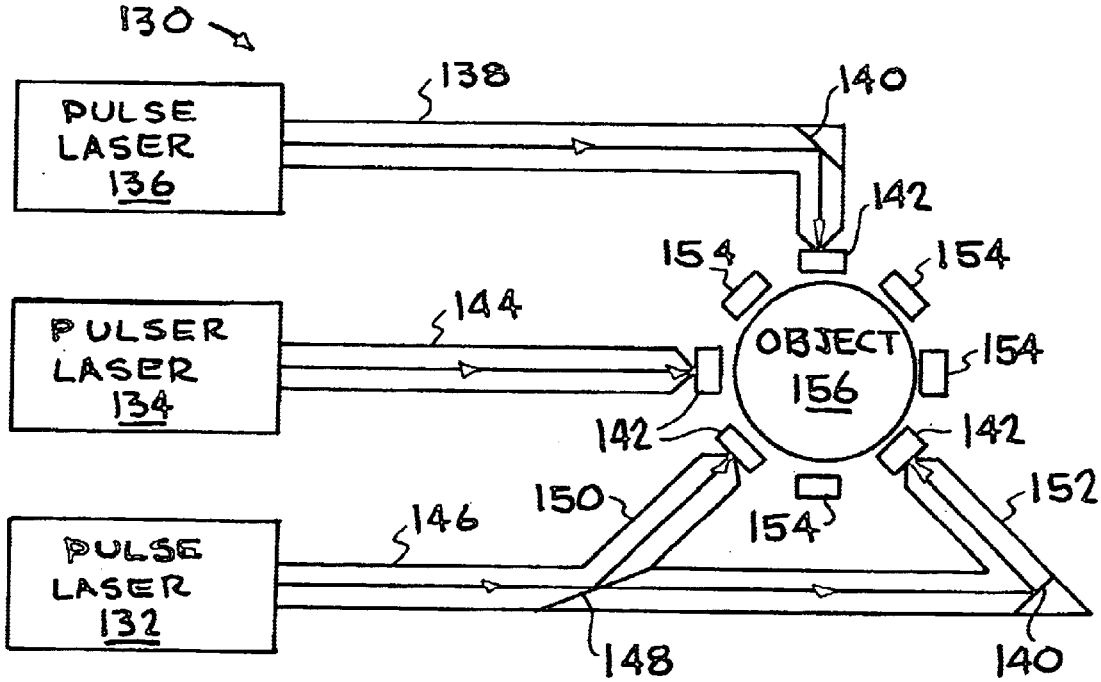
FIG. 8 depicts a multi-axis x-ray system of the second preferred embodiment of the present invention.

Referring to FIG. 7, the graph shows an initial electron spectrum from FXR (curve 126) and petawatt pulse lasers (curve 128) interacting with a target of high conductivity. The petawatt electron spectrum is estimated by the following equation:

$$N(E)dE=C(E^{1/2}/\langle E_e\rangle^{3/2})\mathrm{Exp}[-E/\langle E_e\rangle]dE \quad (1)$$

where C is the normalization constant. The distribution shows that a petawatt pulse laser as the source can produce hard x-rays in the 1–10 MeV range. In contrast, the FXR source produces a well-defined set of electrons around 16 MeV range. The electrons are the source for x-ray production via subsequent bremsstrahlung. Although the electron distributions are different, the x-ray distributions are similar as shown in FIG. 8.

Referring to FIG. 7, the similarities between using an FXR source and a petawatt laser source for hard x-ray production are evident. The distribution of x-rays when calculated from distribution curve 122 for a computer model FXR source. The distribution curve 120 is for the experimental results using an FXR source and distribution curve 124 is for the calculated results using the petawatt laser source. It is clear that use of the petawatt class lasers of the present invention can produce hard x-rays with a spectral distribution similar to that achievable with high-currout induction accelerators despite the very different electron distributions.

The present invention can be focused on an extremely small source size such that more sophisticated bremsstrahlung target designs and higher spatial resolution can be performed. Referring to FIG. 8, a multi-axis configuration of the second preferred embodiment of the present invention 130 is shown. Although this shows only two dimensions, it is clear that this can be expanded to a three-dimensional configuration. Pulse lasers 132, 134, 136 generate laser pulses down conduits 138, 144, 146 respectively. Conduit 144 is a straight tube that allows the laser pulse to strike the target 142. However, the conduit 138 has a mirror 140 to reflect the laser pulse to target 142. The conduit 146 has both a mirror 140 to direct the laser pulse down conduit 152 and a beam splitter 148 to direct part of the laser pulse down conduit 150. On the opposite side of object 156 are detection plates 154.

The distance that the laser pulse travels determines when the x-rays will penetrate the object 156. Therefore, either the lasers could be fired at different times in order to have all of the x-rays penetrate the object at the same time. However, the laser pulses could be timed such that x-rays pass through the object 156 at different time intervals. Since the laser pulse is extremely short and the production of x-rays is concentrated at the time the pulse hits the target and dissipate quickly, x-rays produced by one pulse would not interfere with the x-rays from the next pulse. This can be accomplished by using time-gated detection of the detection plates 154.

As an alternative, one laser can be set up with a multi-pulse format. Instead of a beam splitter 148, a moveable mirror could be used to direct the different pulses down different conduits, the object can be radiographed at several angles and the detection plates would only detect the x-rays for a specific timed pulse. Either of these methods is extremely useful if the object is going through a destructive test and one wants to observe different phases of the objects movement.

It is clear that any application requiring time resolved or high image contrast ballistic x-ray radiography is enabled by the present invention. For example, medical x-rays applications can be improved by the use of ballistic imaging enabled by the picosecond duration of the laser source. As another example, time resolved x-ray images of dynamic events such as ordnance interactions or blade failure in a gas turbine engine will be greatly enhanced.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A method of imaging an object using bremsstrahlung radiation comprising:

generating a laser pulse with a short-pulse high-power laser, which has at least a petawatt strength, onto a high-density target to produce a beam of bremsstrahlung radiation, wherein said laser pulse self-generates magnetic and electric fields to focus said beam of Bremsstrahlung radiation on said object;

radiographing said object in the path of hard x-rays produced by said beam of bremsstrahlung radiation; and detecting said hard x-rays passing through said object.

2. The method of claim 1, wherein said hard x-rays are ballistic x-rays passing through said object during said radiographing step.

3. The method of claim 1, wherein said detecting step detects said hard x-rays by using at least one detector.

4. The method of claim 3, wherein said at least one detector used in said detecting step is time gated to detect said hard x-rays that pass through said object during a specific time period.

5. The method of claim 4, wherein said time period is determined by detecting only ballistic x-rays passing through said object.

6. The method of claim 1, wherein said generating step generates a laser pulse with duration less than ten picoseconds.

7. The method of claim 1, wherein said generating step generates a laser pulse with irradiance greater than $10^{18}$ W/cm$^2$.

8. The method of claim 1, wherein said target has a density greater than 5 g/cm$^3$.

9. The method of claim 1, wherein said target has a high conductivity.

10. The method of claim 9, wherein said target has an atomic number greater than 20.

11. The method of claim 9, wherein said high-density target comprises one of gold and copper.

12. An apparatus for imaging an object with bremsstrahlung radiation comprising:

a short-pulse high-power laser for generating a laser pulse, which has at least a petawatt strength;

a high-density target for generating a beam of bremsstrahulung radiation when said laser pulse strikes said high-density target, wherein said laser pulse self-generates magnetic and electric fields to focus said beam of Bremsstrahlung radiation on said object; and a detector located on an opposite side of said object from said high-density target for detecting hard x-rays produced by said bremsstrahlung radiation passing through said object.

13. The apparatus of claim 12, wherein said detector is time gated to detect said hard x-rays that pass through said object during a specific time period.

14. The apparatus of claim 12, wherein said generating step generates a laser pulse with irradiance greater than $10^{18}$ W/cm$^2$.

15. The apparatus of claim 12, wherein said high-density target has a density greater than 5 g/cm$^3$.

16. The apparatus of claim 12, wherein said high-density target comprises one of gold and copper.

17. A method for producing a source of high-energy electrons comprising the step of focusing a laser pulse generated by a short-pulse high-power laser, which has at least a petawatt strength, onto a high-density target to produce a beam of bremsstrahlung radiation, wherein said laser pulse self-generates magnetic and electric fields to focus said beam of Bremsstrahlung radiation.

18. A method of imaging an object with bremsstrahlung radiation comprising:

generating at least two laser pulses with a short-pulse high-power laser;

directing each laser pulse onto one of at least two high-density targets, which are at different positions near said object, to produce a beam of bremmsstrahlung radiation from each high-density target;

radiographing said object in the path of hard x-rays produced by said beam of bremsstrahlung radiation; and detecting said hard x-rays passing through said object with at least one detector such that said at least one detector is positioned to receive each of said beam of bremsstrahlung radiation.

19. The method of claim 18, wherein a period of time for multiple pulses of said at least two laser pulses is within an excited state period of the laser material of said short pulse high power laser.

20. The method of claim 18, wherein said at least one detector used in said detecting step is time gated to detect said hard x-rays that pass through said object during each laser pulse of said at least two laser pulses.

21. The method of claim 18, wherein a number of detectors of said at least one detector is equivalent to the number of laser pulses such that a separate image for each laser pulse can be obtained.

22. An apparatus for imaging an object with bremsstrahlung radiation comprising:

a short-pulse high-power laser for generating at least two laser pulses;

a conduit with an input opening and at least two output openings, each laser pulse of said at least two laser pulses being directed to a corresponding output opening of said conduit;

at least two targets, each of said targets being located at a corresponding output opening of said conduit; and at least two detectors for detecting hard x-rays produced by said bremsstrahlung radiation, each detector corresponding to an output opening of said conduit such that x-rays passing through said object will be detected.

23. The apparatus of claim 22, wherein said conduit comprises at least one moveable mirror for directing said laser pulses.

24. The apparatus of claim 22, wherein said conduit comprises at least one beam splitter for directing said laser pulses.

* * * * *